US009305408B2

(12) United States Patent
Kwon et al.

(10) Patent No.: US 9,305,408 B2
(45) Date of Patent: Apr. 5, 2016

(54) MULTIPLE ELECTRONIC CONTROL UNIT DIAGNOSING SYSTEM AND METHOD FOR VEHICLE

(71) Applicants: Hyundai Motor Company, Seoul (KR); YURA CORPORATION CO., LTD., Chungcheongbuk-do (KR)

(72) Inventors: Hae Yun Kwon, Hwaseong-si (KR); Jun Seo Park, Hwaseong-si (KR); Dong Min Bae, Seoul (KR); Duk Jun Kim, Bucheon-si (KR)

(73) Assignees: Hyundai Motor Company, Seoul (KR); Yura Corporation Co., Ltd., Chungcheongbuk-do (KR)

( * ) Notice: Subject to any disclaimer, the term of this patent is extended or adjusted under 35 U.S.C. 154(b) by 144 days.

(21) Appl. No.: 14/088,239

(22) Filed: Nov. 22, 2013

(65) Prior Publication Data

US 2014/0365067 A1 Dec. 11, 2014

(30) Foreign Application Priority Data

Jun. 7, 2013 (KR) ..... 10-2013-0065088

(51) Int. Cl.
*G07C 5/00* (2006.01)
*G07C 5/08* (2006.01)

(52) U.S. Cl.
CPC ..... *G07C 5/0808* (2013.01); *G07C 2205/02* (2013.01)

(58) Field of Classification Search
CPC ..... G07C 5/0808; G07C 2205/02
See application file for complete search history.

(56) References Cited

U.S. PATENT DOCUMENTS 6,314,422 B1 * 11/2001 Barker ..... G06F 17/30887 340/539.1
8,897,952 B1 * 11/2014 Palmer ..... G07C 5/008 701/29.1
2002/0123833 A1 * 9/2002 Sakurai et al. ..... 701/33
2007/0135981 A1 * 6/2007 Raichle ..... G07C 5/008 701/36
2007/0198144 A1 * 8/2007 Norris ..... G05D 1/0246 701/23
2009/0271067 A1 * 10/2009 Underdal ..... G01M 15/02 701/33.4
2009/0299566 A1 * 12/2009 Tanigawa et al. ..... 701/33
2009/0300548 A1 * 12/2009 Sullivan ..... G06F 3/0482 715/830

(Continued)

FOREIGN PATENT DOCUMENTS

JP 2008-070368 A 3/2008
JP 2012-156803 A 8/2012

(Continued)

*Primary Examiner* — Mussa A Shaawat
(74) *Attorney, Agent, or Firm* — McDermott Will & Emery LLP

(57) ABSTRACT

A multiple electronic control unit (ECU) diagnosing system and a method thereof for a vehicle by which a diagnosis time for an ECU can be shortened by using an Ethernet protocol and a communication gateway. The multiple ECU diagnosing system for the vehicle applies a multiple ECU diagnosing algorithm of a one-to-n method which is more efficient than a diagnosis algorithm of a one-to-one method between diagnostic equipment. ECUs for the vehicle are connected through various communication networks (K-Line, CAN, LIN, FlexRay, and MOST) by using a communication gateway transferring messages and signals between the ECUs, thus significantly shortening a diagnosis time for the ECUs and acquiring a large amount of diagnosis information at the same time.

6 Claims, 6 Drawing Sheets

(56) References Cited

U.S. PATENT DOCUMENTS

2010/0161172 A1* 6/2010 Bjelkstal ..... 701/33
2010/0189120 A1* 7/2010 Diab ..... H04L 12/40 370/401
2010/0321175 A1* 12/2010 Gilbert ..... B60R 16/0234 340/438
2010/0324376 A1* 12/2010 Chinnadurai ..... G06Q 50/22 600/300
2011/0160952 A1* 6/2011 Thomas ..... G05B 19/0426 701/31.4
2013/0166138 A1* 6/2013 Yun ..... G07C 5/0841 701/32.6
2013/0226483 A1* 8/2013 McGee ..... G05B 19/0423 702/60
2013/0304306 A1* 11/2013 Selkirk ..... G07C 5/008 701/31.4
2014/0109075 A1* 4/2014 Hoffman ..... G06F 8/65 717/169
2014/0180531 A1* 6/2014 Lipscomb ..... G07C 5/008 701/33.2
2014/0245284 A1* 8/2014 Alrabady ..... G06F 8/65 717/173
2014/0350772 A1* 11/2014 Saito ..... 701/29.1

FOREIGN PATENT DOCUMENTS

KR 10-0168308 B1 10/1998
KR 10-1999-0056164 A 7/1999
KR 10-2002-0022576 A 3/2002
KR 10-2010-0015510 A 2/2010

* cited by examiner

| Structure | Data Length | | | | | | | | | | | | Diagnostic Number | | | | Diagnostic ID (0~15) | | | | | | | | | | | | | | | |
|---|---|---|---|---|---|---|---|---|---|---|---|---|---|---|---|---|---|---|---|---|---|---|---|---|---|---|---|---|---|---|---|---|
| bit | 1 | 2 | 3 | 4 | 5 | 6 | 7 | 8 | 9 | 10 | 11 | 12 | 1 | 2 | 3 | 4 | 1 | 2 | 3 | 4 | 5 | 6 | 7 | 8 | 9 | 10 | 11 | 12 | 13 | 14 | 15 | 16 |
| | Diagnostic ID (0~15) | | | | | | | | | | | | | | | | | | | | | | | | | | | | | | | |
| | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 | 41 | 42 | 43 | 44 | 45 | 46 | 47 | 48 |
| | Diagnostic ID (0~15) | | | | | | | | | | | | | | | | Sub Data Length | | | | | | | | | | | | | | | |
| | 49 | 50 | 51 | 52 | 53 | 54 | 55 | 56 | 57 | 58 | 59 | 60 | 61 | 62 | 63 | 64 | 1 | 2 | 3 | 4 | 5 | 6 | 7 | 8 | 9 | 10 | 11 | 12 | 13 | 14 | 15 | 16 |
| | Sub Data Length | | | | | | | | | | | | | | | | | | | | | | | | | | | | | | | |
| | ~ | | | | | | | | | | | | | | | | | | | | | | | | | | | | | | | |
| | Sub Data Length | | | | | | | | | | | | | | | | Reserved | | | | | | | | | | | | | | | |
| | 177 | 178 | 179 | 180 | 181 | 182 | 183 | 184 | 185 | 186 | 187 | 188 | 189 | 190 | 191 | 192 | 1 | 2 | 3 | 4 | 5 | 6 | 7 | 8 | 9 | 10 | 11 | 12 | 13 | 14 | 15 | 16 |
| | Data | | | | | | | | | | | | | | | | | | | | | | | | | | | | | | | |
| | ~ MSS. | | | | | | | | | | | | | | | | | | | | | | | | | | | | | | | |

FIG.6

MULTIPLE ELECTRONIC CONTROL UNIT DIAGNOSING SYSTEM AND METHOD FOR VEHICLE

CROSS-REFERENCE TO RELATED APPLICATION

This application claims under 35 U.S.C. §119(a) the benefit of Korean Patent Application No. 10-2013-0065088, filed on Jun. 7, 2013, the entire contents of which are incorporated herein by reference.

TECHNICAL FIELD

The present disclosure relates to a multiple electronic control unit (ECU) diagnosing system and method for a vehicle. More particularly, the present disclosure relates to a multiple ECU diagnosing system for a vehicle by which a diagnosis time for an ECU can be shortened by using an Ethernet protocol and a communication gateway, and a multiple ECU diagnosing method for the same.

BACKGROUND

A plurality of electronic control units (ECUs) in a vehicle are configured to control various electric components. The ECUs need to be diagnosed for checking on the overall vehicle state.

The number of ECUs mounted on a vehicle has been gradually increasing as the number of functions for convenience and safety of the vehicle increases. The ECUs are connected to each other through communication networks of various speeds according to the necessary communication environment.

According to a conventional ECU diagnosing method for a vehicle, diagnostic equipment and ECUs are connected to each other through on-board diagnostics (OBD) terminals of the vehicle. A diagnosis process for one ECU uses a one-to-one communication method between the diagnostic equipment and the ECUs, and a sequential diagnosis algorithm for diagnosing the next ECU is performed after the first ECU diagnosis process is completed.

An example of the conventional ECU diagnosing method for a vehicle will be described with reference to FIG. 1 hereinafter.

As shown in FIG. 1, ECU diagnostic equipment diagnoses four ECUs, including P-ECU(1), C-ECU(1), M-ECU(1), and B-ECU(1) connected to different communication channels, respectively. That is, the diagnostic equipment diagnoses the ECUs through one-to-one connections between the diagnostic equipment and the ECUs, and sequential diagnosis processes.

In more detail, in order to diagnose the plurality of ECUs, the diagnostic equipment completes diagnosis of P-ECU(1) of channel 1 (CH-1) and diagnoses C-ECU(1) of channel 2 (CH-2), completes diagnosis of C-ECU(1) of channel 2 (CH-2) and diagnoses M-ECU(1) of channel 3 (CH-3), and so on. In this way, the diagnostic equipment performs a total of five diagnosis processes.

Then, since the ECUs are connected through communication networks (for example, Ethernet: 100 Mbps, FlexRay: 2.5 Mbps to 10 Mbps, CAN: 100 Kbps to 1 Mbps, LIN: 10 to 40 Kbps, K-Line: 10.4 Kbps) of various speeds, the diagnosis process speeds of the diagnostic equipment are also influenced by the speeds of the communication networks.

The ECUs of specific devices, such as a plurality of electric components in the vehicle, which are connected through different networks and the diagnostic equipment, should be one-to-one connected to each other and sequentially diagnose the ECUs in order to check states of the specific devices. Therefore, data transmission time is different from each other according to the speeds of the networks connected to the ECUs, and the state information of all the devices can be identified through the information collected by the diagnostic equipment after all the diagnosis processes are sequentially performed.

Hereafter, the conventional ECU diagnosing method will be described in detail.

A plurality of ECUs configured in a vehicle are connected to each other through a communication gateway having networks of different speeds. Diagnosis processes between diagnostic equipment and the ECUs are performed through the communication gateway, and diagnostic information of the vehicle flows through a sequential path of diagnostic equipment, a network, a gateway, a network, an ECU, a network, the gateway, a network, and the diagnostic equipment.

For example, when P-ECU(1) is diagnosed as shown in FIG. 1, diagnostic information of the vehicle flows through a sequential path of the diagnostic equipment, a network D-CAN, the gateway, a network P-CAN, P-ECU(1), the network P-CAN, the gateway, the network D-CAN, and the diagnostic equipment.

In order to obtain one ECU information element, the diagnostic information should be transferred via a network, a gateway, and a network each time. Thereby, the transfer time of the generated diagnostic information data is increased in proportion to the number of ECUs.

In order to diagnose one ECU, the diagnostic equipment performs several transmissions and receptions of signals with the corresponding ECU. If a data transmission time through a network is Tn, the number of transmissions/receptions of the signals for a diagnosis of the ECU is N, the number of ECUs to be diagnosed is M, and the number of CAN communication networks (that can be changed according to the number of CAN communication networks) is 4, the data transmission time Tt for diagnosing the ECUs is expressed as in Equation 1, and the data transmission time Tt is significantly increased as the number of ECUs to be diagnosed is increased.

$$Tt=M*N*4*Tn \qquad \text{Equation 1:}$$

In Equation 1, a difference in transfer time Tn through a network is generated according to the transfer time of the network. When the data transmission time through an Ethernet communication network is "1e", which has the fastest communication speed, it may be assumed that the data transmission time through a FlexRay communication network is "10e", which has the second fastest speed, and the data transmission time through a CAN communication network is "100e", which has the slowest speed.

In general, the data transmission time is 100 Mbps for the Ethernet, 10 Mbps for FlexRay, and 1 Mbps for CAN with reference to the maximum bit rate, respectively.

Here, an example of obtaining data transmission time when ECUs are diagnosed according to the related art will be described below.

As shown in FIG. 1, in a state in which an ECU diagnostic equipment for a vehicle and a gateway are connected to each other through a D-CAN network, the gateway and ECU(1), ECU(2), ECU(3), and ECU(4) are connected to each other through CAN communications P-CAN, C-CAN, M-CAN, and B-CAN, respectively. When the gateway and the ECU(5) are connected to each other through a FlexRay communica tion network, a total diagnosis time Tt is obtained in Equation 2.

$$Tt=4*(200e+100e+100e+200e)+(200e+10e+100e+200e)=2820e \quad \text{Equation 2:}$$

It is assumed in Equation 2 that the number N of transmissions and receptions of signals for diagnosis of ECUs and a latency time through a gateway are omitted.

For example, when a diagnosis process for ECU(1) is performed, diagnostic information of a vehicle flows through a sequential path of diagnostic equipment, a network D-CAN, the gateway, a network P-CAN, P-ECU(1), a network P-CAN, the gateway, the network D-CAN, and the diagnostic equipment.

Referring to FIGS. 1 and 2, a total data transmission/reception time of 600e includes a CAN communication data transmission time 100e for which a signal is transmitted from the diagnostic equipment to the gateway via the network D-CAN, and a CAN communication data transmission time 100e for which a signal is transmitted from the gateway to CH-1 (P-CAN) connected to ECU(1). A CAN communication data transmission time 100e for which a signal is transmitted from CH-1 to ECU(1), and a CAN communication data reception time 100e for which a signal is transmitted from ECU(1) to CH-1 are consumed. The total data transmission/reception time of 600e further includes a CAN communication data transmission time 100e for which a signal is transmitted from CH-1 to the gateway, and a CAN communication data reception time 100e for which a signal is transmitted from the gateway to diagnostic equipment.

Then, since ECU(2), ECU(3), ECU(4), and ECU(1) are connected to the diagnostic equipment and the CAN communication network, the total data transmission/reception time of 600e is consumed.

ECU(5) is connected to a FlexRay communication network through the gateway and channel 5 (CH-5). Therefore, a data transmission time from CH-5 to ECU(5) of 10e and a data reception time from ECU(5) to CH-5 of 10e are consumed, and thus, the total data transmission/reception time of 420e is consumed.

In this way, when ECU(1) to ECU(5) to be diagnosed are connected to each other through different communication channels, the total time for which all information is transferred to the diagnostic equipment is 2820e.

Hereinafter, another example of obtaining a data transmission time when ECUs are diagnosed according to the related art will be described.

When five ECUs, that are connected to one identical CAN communication channel, are diagnosed to check states of the ECUs, a time Tt for which the entire diagnosis is performed is obtained as follows.

$$Tt=5*(200e+100e+100e+200e)=3000e \quad \text{Equation 3:}$$

In Equation 3, the number of transmissions and receptions for diagnosis of the ECUs is assumed to be 1, and a latency time through the gateway is omitted.

Since the time for which one ECU is diagnosed is 600e (200e+100e+100e+200e), the total time for which all information of the ECUs to be diagnosed are transferred to the diagnostic equipment is 3000e when the five ECUs are connected to each other in series through the CAN communication channel is 3000e.

According to the ECU diagnosing method of the related art, since the ECUs of specific devices connected to each other through different communication networks should be one-to-one connected to the diagnostic equipment to be sequentially diagnosed, data transmission time will be different from each other according to the speeds of the networks connected to the ECUs, and it will require long hours for transmission/reception of diagnosis data.

SUMMARY

The present disclosure provides a multiple electronic control unit (ECU) diagnosing system for a vehicle which applies a multiple ECU diagnosing algorithm of a one-to-n method which is more efficient than a diagnosis algorithm of a one-to-one method between diagnostic equipment and ECUs for the vehicle connected through various communication networks, such as, K-Line, CAN, LIN, FlexRay, and MOST by using a communication gateway to transfer messages and signals between the ECUs, thus significantly shortening a diagnosis time for the ECUs and acquiring a large amount of diagnosis information at the same time, and a multiple ECU diagnosing method for the same.

In accordance with an aspect of the present disclosure, a multiple electronic control unit (ECU) diagnosing system for a vehicle includes diagnostic equipment installed in the vehicle in which multiple diagnostic information software (MDIS) for the diagnostic equipment capable of handling diagnostic instructions for a plurality of ECUs and transmitting and receiving signals. A multiple diagnostic protocol (MDP) which is an Ethernet communication protocol having a data structure for multiple diagnoses between the diagnostic equipment and a gateway of the vehicle, and a diagnostic distribution system (DDS) for analyzing the multiple diagnostic protocol and performing diagnosis communications with the ECUs connected to the gateway through a network are provided in the multiple ECU diagnosing system.

In accordance with another aspect of the present disclosure, a multiple ECU diagnosing method for a vehicle includes inputting diagnosis request information for multiple diagnoses of a plurality of ECUs through multiple diagnostic information software (MDIS). The input diagnosis request information is transmitted toward a gateway of the vehicle connected from diagnostic equipment through an Ethernet communication network in the form of a multiple diagnostic protocol (MDP). The multiple diagnostic protocol (MDP) transmitted from the multiple diagnostic information software (MDIS) through the Ethernet communication network is transmitted to a diagnostic distribution system (DDS) of the gateway of the vehicle. Information on an ECU to be diagnosed from the multiple diagnostic protocol is analyzed, and diagnostic communications with the ECUs in the diagnostic distribution system (DDS) are performed. A response message on the diagnosis request information through a communication network to the diagnostic distribution system (DDS) in the respective ECUs is transmitted. The response message of the ECU collected by the diagnostic distribution system (DDS) is recombined, and the response message to the software (MDIS) of the diagnostic equipment through the Ethernet communication network is transmitted. Then, the recombination information of the multiple diagnostic protocol is analyzed, and the multiple diagnosis results for the ECUs is provided to a user.

The present disclosure can apply a multiple ECU diagnosing algorithm of a one-to-n method which is more efficient than a diagnosis algorithm of a one-to-one method between diagnostic equipment and ECUs for a vehicle connected through various communication networks, such as, K-Line, CAN, LIN, FlexRay, and MOST by using a communication gateway to transfer messages and signals between the ECUs, thus significantly shortening a diagnosis time for the ECUs and acquiring a large amount of diagnosis information at the same time, and a multiple ECU diagnosing method for a vehicle.

A diagnosis speed can be significantly shortened even for a plurality of ECUs connected to the same network of the same speed as well as multiple different communication networks.

Further, the present disclosure can shorten an ECU diagnosing time for checking a vehicle and recognizes a state of the vehicle to reduce an ECU checking time in a production line of the vehicle in addition to a repair time of the vehicle, thereby improving productivity.

BRIEF DESCRIPTION OF THE DRAWINGS

The above and other features of the present disclosure will now be described in detail with reference to certain exemplary embodiments thereof illustrated the accompanying drawings which are given hereinafter by way of illustration only, and thus are not limitative of the present disclosure.

FIG. 6 is an illustration showing a data format of a multiple diagnostic protocol according to the present disclosure.

Figure 1:
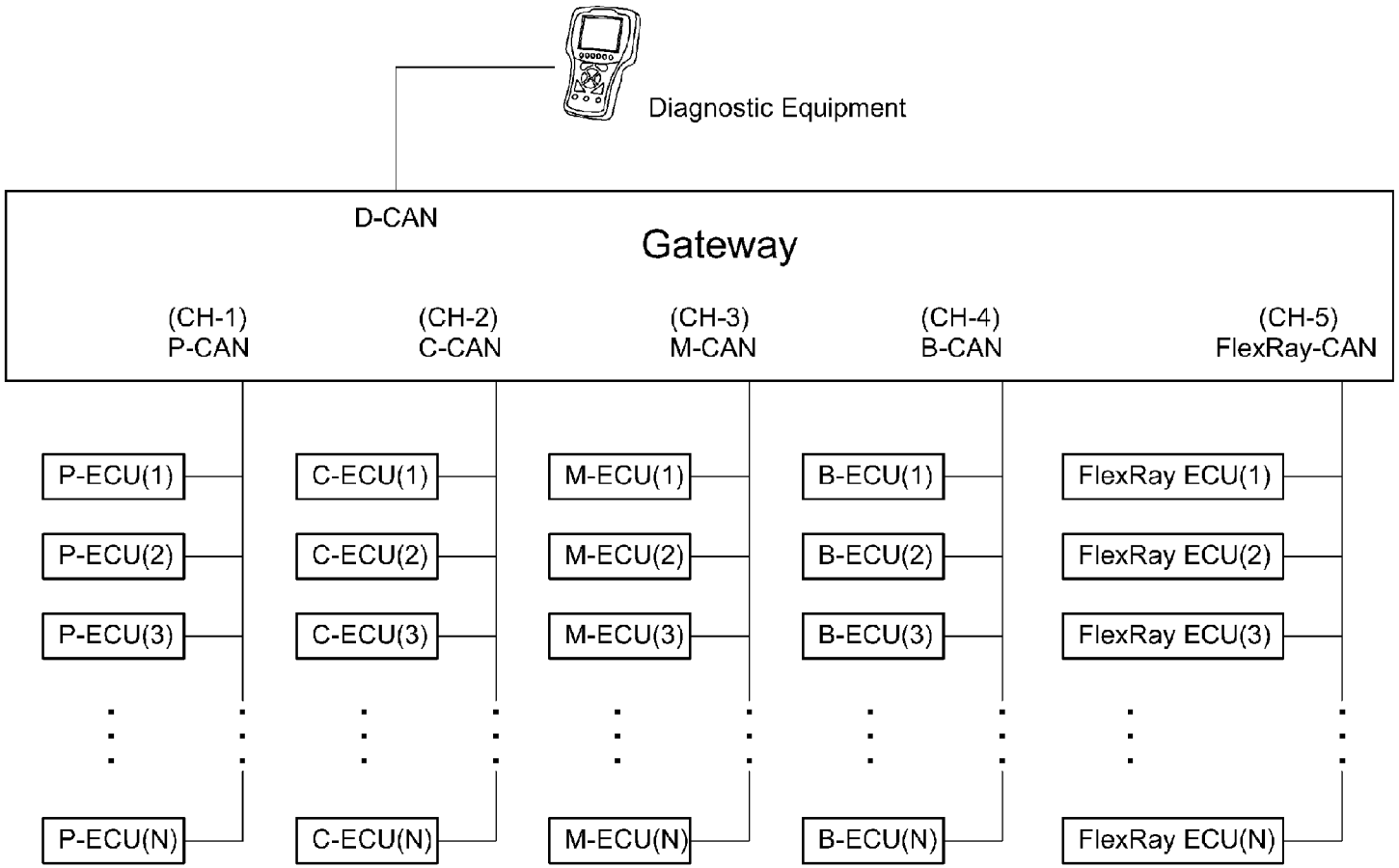
FIG. 1 is a diagram showing an electronic control unit (ECU) diagnosing system according to the related art.
Figure 2:
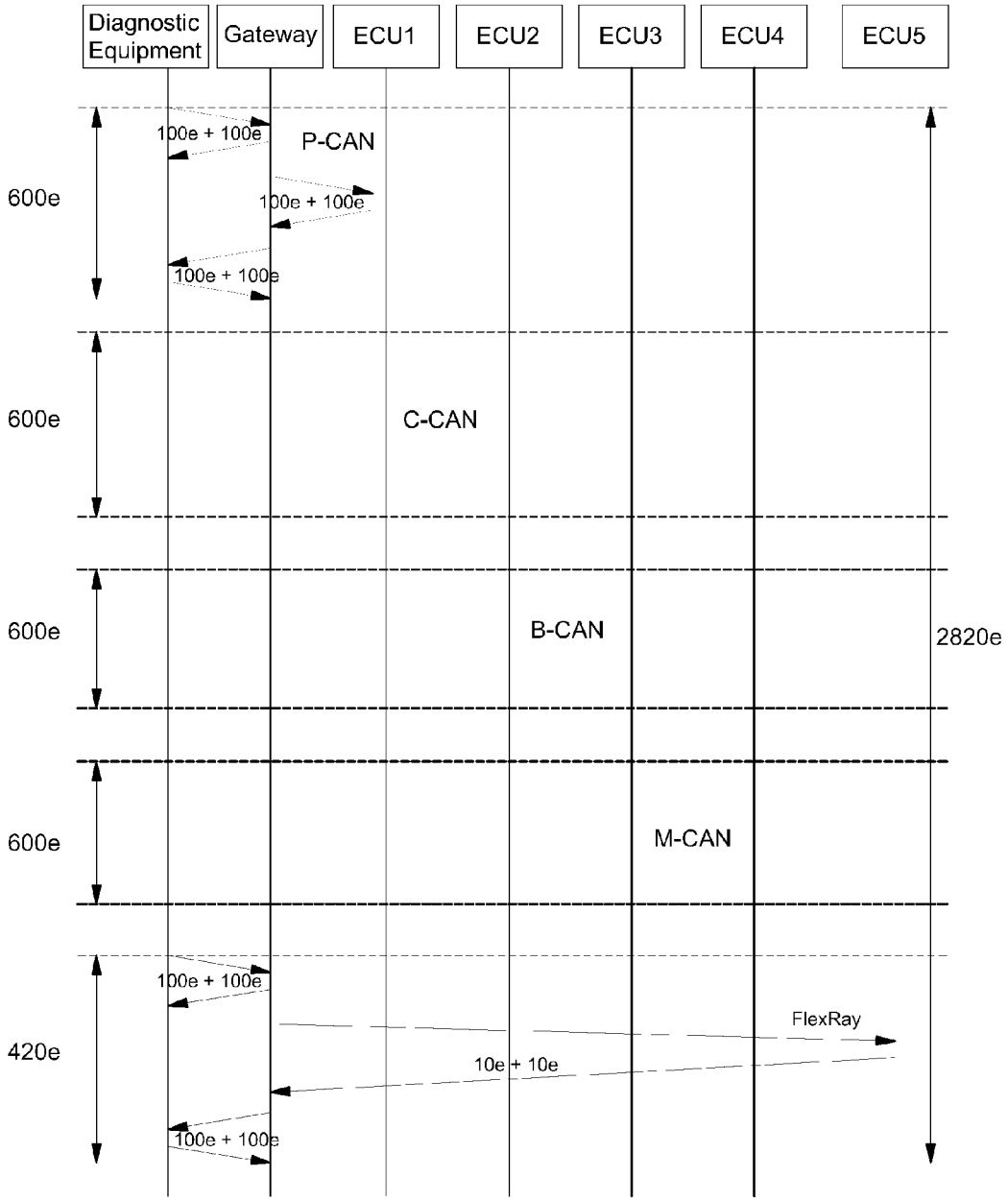
FIG. 2 is a linear algorithm showing an ECU diagnosing method according to the related art.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Hereinafter, exemplary embodiments of the present disclosure will be described in detail with reference to the accompanying drawings.

According to the present disclosure, a plurality of electronic control units (ECUs) connected to a network of a vehicle through a gateway can be diagnosed in a multiple fashion by using high speed Ethernet communication network of a high speed and an Ethernet protocol, so that diagnosis speeds of the ECUs can be significantly shortened.

Figure 3:
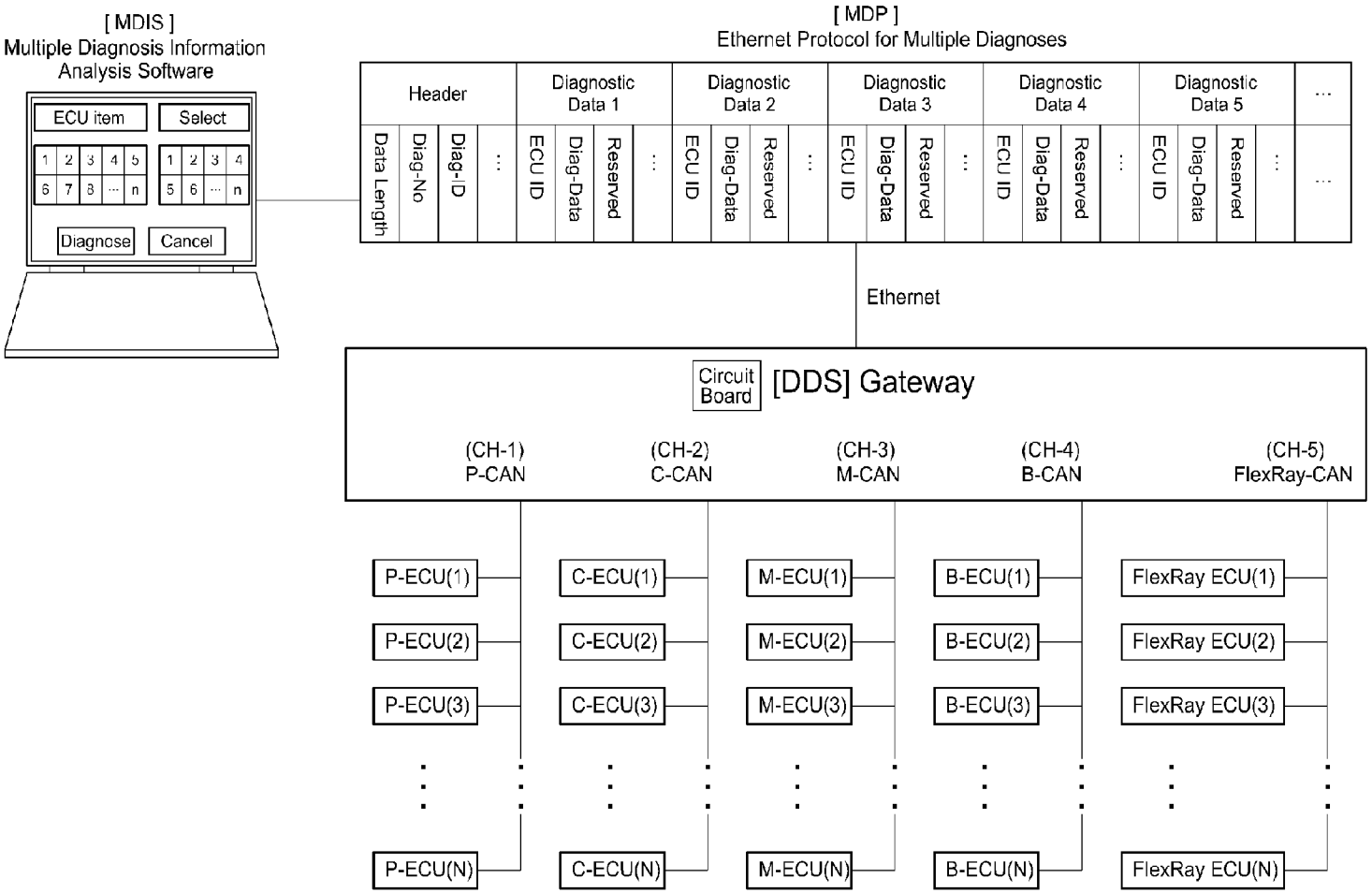
FIG. 3 is a diagram showing a multiple ECU diagnosing system for a vehicle according to the present disclosure.
Figure 4:
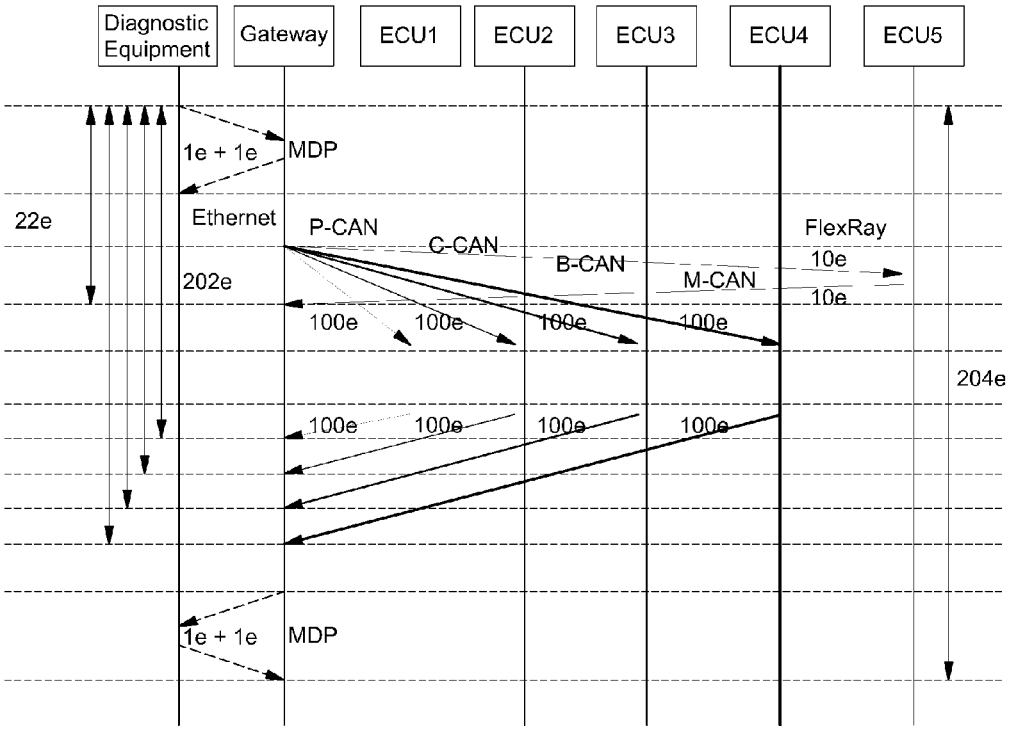
FIG. 4 is a linear algorithm showing a multiple ECU diagnosing method for a vehicle according to the present disclosure.

Referring to FIG. 3, the multiple ECU diagnosing system for a vehicle according to the present disclosure includes diagnostic equipment (e.g. a computer) installed in the vehicle in which multiple diagnostic information software (MDIS), which is software for diagnostic equipment capable of instructing diagnoses of a plurality of ECUs and transmitting and receiving signals, and a multiple diagnostic protocol (MDP) are provided, which corresponds to an Ethernet communication protocol having a data structure for multiple diagnoses between the diagnosis equipment and the gateway. A diagnostic distribution system (DDS) analyzes the multiple diagnostic protocol (MDP) and performs a diagnostic communication with the ECUs connected to the gateway through a network.

The diagnostic equipment and the diagnostic distribution system (DDS) of the gateway are connected to communicate with each other through an Ethernet communication network. The plurality of ECUs transmitting and receiving diagnostic information to and from the diagnostic distribution system are connected to each other by using different communication networks or through one identical communication network.

The communication networks having different speeds may include a CAN communication network, a FlexRay communication network, a LIN communication network, and a K-Line communication network. One identical communication network is then selected from a CAN communication network, a FlexRay communication network, a LIN communication network, and a K-Line communication network.

For reference, among the communication networks, the Ethernet communication network has a transmission speed of 100 Mbps, the FlexRay communication network has a transmission speed of 2.5 to 10 Mbps, the CAN communication network has a transmission speed of 10 Kbps to 1 Mbps, the LIN communication network has a transmission speed of 10 to 40 Kbps, and the K-Line communication network has a transmission speed of 10.4 Kbps.

Hereinafter, a multiple ECU diagnosing method for a vehicle according to the present disclosure will be described.

In order to perform a multiple diagnostic operation for a plurality of ECUs installed in the vehicle, diagnosis request data for the ECUs are input through multiple diagnostic information software (MDIS) of diagnostic equipment.

Subsequently, the input diagnosis request data are transmitted toward the gateway of the vehicle connected from the diagnostic equipment through the Ethernet in the form of a multiple diagnostic protocol (MDP).

Then, the multiple diagnostic information software (MDIS) of the diagnostic equipment is transmitted through the Ethernet communication by recombining the diagnosis request information of a multiple diagnosis item selected by the user with the multiple diagnostic protocol (MDP). The multiple diagnostic protocol (MDP) includes information including the type and number of the ECUs to be diagnosed, and the communication network type connected to the ECUs.

Subsequently, the multiple diagnostic protocol (MDP) transmitted from the software (MDIS) of the diagnostic equipment through the Ethernet communication is transmitted to the diagnostic distribution system of the gateway of the vehicle.

The diagnostic distribution system (DDS) analyzes information such as a list and type of the ECUs to be diagnosed, and communication network type connected to the ECUs from the received multiple diagnostic protocol to perform a diagnostic communication with the ECUs. The ECUs transmit a response message to the diagnostic distribution system (DDS) through a communication network, so that the diagnostic distribution system (DDS) receives the response message collected from the ECUs.

After the response message (diagnostic information) of the ECUs collected from the ECUs by the diagnostic distribution system (DDS) is recombined by the multiple diagnostic protocol (MDP), the message is transmitted to the software (MDIS) of the diagnostic equipment through the Ethernet communication line. Then, the software (MDIS) of the diagnostic equipment analyzes recombination information of the multiple diagnostic protocol (MDP) to provide the multiple diagnostic result for the ECUs to the user while displaying the result on a monitor.

Hereinafter, a multiple ECU diagnosing method for a vehicle according to an embodiment of the present disclosure will be described.

When diagnoses for checking states of five ECUs connected through different channels, that is, different communication networks are performed, for example, when the diagnostic distribution system (DDS) is connected to ECU(1), ECU(2), ECU(3), and ECU(4) through the CAN communications (P-CAN CH1, C-CAN CH2, M-CAN CH3, and B-CAN CH4, respectively) and is connected to ECU(5) through the FlexRay communication network CH5, a total diagnosis time Tt is obtained in Equation 4 as follows.

$$Tt=2e+(100e+100e)+2e=204e \quad \text{Equation 4:}$$

It can be seen that while the total diagnosis time (Tt) according to the related art is 2820e, the total time (time for which all information of the ECUs to be diagnosed is transferred to the diagnostic equipment) through the diagnosis process by the diagnostic distribution system (DDS) according to the present disclosure is 204e.

The reason why the diagnosis speed according to the related art is much slower is that, in the related art, the network use time is consumed whenever a diagnosis is performed as the ECUs are diagnosed through the one-to-one connection between the ECUs and the sequential diagnosis process.

On the other hand, according to the diagnosis method of the present disclosure, a data transmission speed at which multiple diagnostic instructions input from the software (MDIS) of the diagnostic equipment by the user are transferred to the diagnostic distribution system (DDS) of the gateway through one multiple diagnostic protocol (MDP) is 2e, and the diagnostic distribution system (DDS) can implement a diagnostic instruction to the ECUs through the communication networks and receives a response message (diagnostic information) from the ECUs. The diagnosis time is thus shortened since a data transmission speed at which the response message is finally transferred to the software (MDIS) of the diagnostic equipment through an Ethernet communication is 2e.

Although data transmission/reception times are different according to the communication network type connecting the diagnostic distribution system (DDS) of the gateway and the ECUs, the data transmission speed between the diagnostic distribution system (DDS) and the ECUs is 100e+100e when they are connected through the CAN communication network, and the data transmission speed between the diagnostic distribution system (DDS) and the ECUs is 10e+10e when they are connected through the FlexRay communication network.

Thus, after the diagnosis information received from the ECUs is recombined by the diagnostic distribution system in the form of a multiple diagnostic protocol (MDP), it is then transferred to the software (MDIS) of the diagnostic equipment through the Ethernet communication.

Consequently, it can be seen that since the total time (Tt) through the diagnosis process by the diagnostic distribution system (DDS) of the present disclosure is 2e+(100e+100e)+2e=204e, the time for diagnosing the ECU can be significantly shortened as compared with the related art.

According to the diagnosis method of the present disclosure, the diagnosis time can be shortened even when the ECUs to be diagnosed are connected to the same communication network instead of different communication networks.

For example, when five ECUs connected to one network (P-CAN) is to be diagnosed, the time (Tt) according to the present disclosure is obtained as in Equation 5 while the total time (Tt) for a diagnosis is 3000e.

$$Tt=2e+5*(100e+100e)+2e=1004e \quad \text{Equation 5:}$$

In more detail, a data transmission speed at which a multiple diagnostic instruction input from the software (MDIS) of the diagnosis equipment by the user to the diagnostic distribution system (DDS) of the gateway through the Ethernet communication after the multiple diagnostic instruction is determined by one multiple diagnostic protocol is 2e, and a data transmission speed at which a response message is finally transferred to the software (MDIS) of the diagnostic equipment through the Ethernet communication after the diagnostic instruction is implemented to the ECUs through one communication network. A response message (diagnosis information) is received from the ECU at the same time, and thus, the diagnostic distribution system (DDS) can shorten the ECU diagnosis time as compared with the related art.

In the case in which the one communication network is a CAN communication network, a response time of the five ECUs connected to the network is 5*(100e+100e)=1000e when the diagnostic instruction is transmitted to and received from the ECUs by the diagnostic distribution system.

Figure 5:
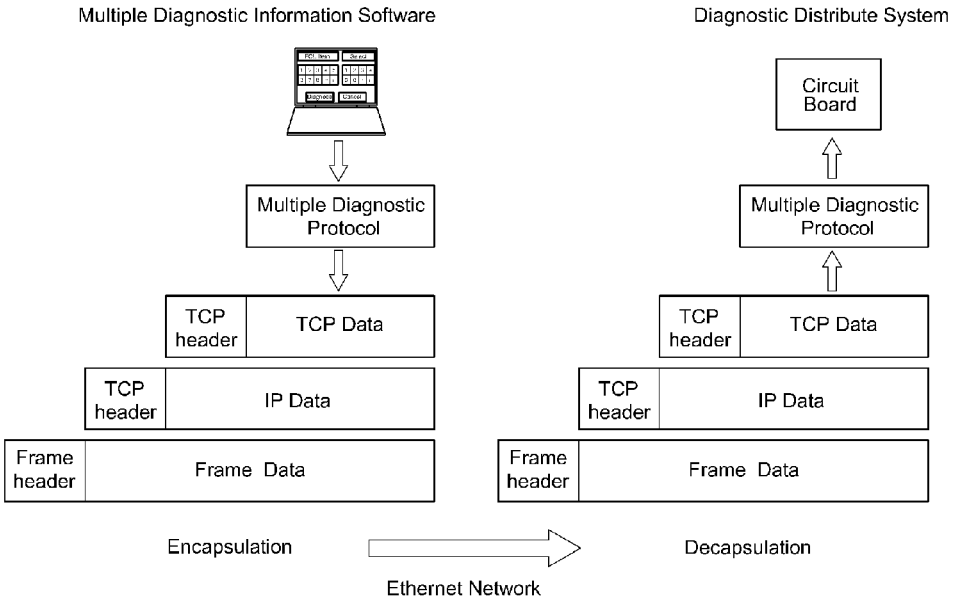
FIG. 5 is an illustration showing an example of configuring data of a multiple diagnostic protocol (MDP) according to the present disclosure.

Referring to FIG. 5, the multiple diagnostic information input from the software (MDIS) of the diagnosis equipment by the user includes multiple diagnosis protocol (MDP) data. This information is stored in a payload of a transmission control protocol (TCP) packet encapsulated into an internet protocol (IP) packet and an Ethernet frame by using 13,400 ports, and transmitted to the diagnostic distributions system which is a destination. Then, IP addresses of the software (MDIS) of the diagnostic equipment and the diagnostic distribution system are either automatically or manually given a local network and generally uses a private IP of a C-class (ex. 192.168.x.x).

The Ethernet frame transmitted to the diagnostic distribution system (DDS) through the Ethernet network is decapsulated by the software (MDIS) of the diagnosis equipment, and the multiple diagnostic protocol (MDP) data are received by the diagnostic distribution system (DDS) through the TCP/IP packet.

Subsequently, the received multiple diagnostic protocol (MDP) data are separated into diagnostic instruction messages to be transmitted to the communication network connected to the ECU by the diagnostic distribution system (DDS), and the diagnostic instruction is transmitted to the ECU of the corresponding network.

After the diagnosis messages (diagnostic information) received from the ECUs of the networks are recombined into a multiple diagnostic protocol by the diagnostic distribution system (DDS), they are transmitted to the software (MDIS) of the diagnostic equipment through the Ethernet communication network.

Referring to FIG. 6, the multiple diagnostic protocol (MDP) data include headers and data for respective sections. The header area includes data lengths, diagnostic numbers, diagnostic IDs, sub data lengths, and the data area is an area for listing diagnostic data.

As described above, according to the ECU diagnosing system and method for a vehicle, when ECUs connected to vehicular networks of different speeds through a gateway is diagnosed in a multiple fashion, diagnosis speed can be significantly shortened as a protocol through the Ethernet of a high speed is applied. Further, diagnosis speed can be significantly shortened for a plurality of ECUs connected to the same network of the same speed as well as multiple different communication networks.

What is claimed is:

1. A multiple electronic control unit (ECU) diagnosing system for a vehicle, comprising:

diagnostic equipment installed in the vehicle and having multiple diagnostic information software (MDIS) to provide diagnostic instructions for a plurality of ECUs and to transmit and receive signals;

a multiple diagnostic protocol (MDP) which is an Ethernet communication protocol having a data structure for multiple diagnoses between the diagnostic equipment and a gateway of the vehicle; and a diagnostic distribution system (DDS) for analyzing the MDP and performing diagnosis communications with the ECUs connected to the gateway through a network, wherein the diagnostic equipment and the DDS of the gateway are connected to each other through an Ethernet communication network, and wherein the plurality of ECUs, which transmit and receive diagnostic information to and from the DDS, are connected to each other through different communication networks or through one identical communication network.

2. The multiple ECU diagnosing system of claim 1, further comprising: communication networks of different speeds including a CAN communication network, a FlexRay communication network, a LIN communication network, and a K-Line communication network, and wherein the one identical communication network is selected from the CAN communication network, the FlexRay communication network, the LIN communication network, and the K-Line communication network.

3. A multiple electronic control unit (ECU) diagnosing method for a vehicle, comprising:

inputting diagnosis request information for multiple diagnoses of a plurality of ECUs through MDIS;

transmitting the input diagnosis request information toward a gateway of the vehicle connected from diagnostic equipment through an Ethernet communication network in the form of an MDP;

transmitting the MDP transmitted from the MDIS through the Ethernet communication network to a DDS of the gateway of the vehicle;

analyzing information on an ECU to be diagnosed from the MDP and performing diagnostic communications with the ECUs in the DDS;

transmitting a response message on the diagnosis request information through a communication network to the DDS in the respective ECUs;

recombining the response message of the ECU collected by the DDS and transmitting the response message to the MDIS of the diagnostic equipment through the Ethernet communication network; and analyzing the recombination information of the MDP and providing multiple diagnosis results for the ECUs to a user, wherein when the multiple diagnoses for the plurality of ECUs is performed, the diagnostic equipment and the DDS of the gateway is connected to the Ethernet communication network and the DDS, and wherein the plurality of ECUs transmit and receive diagnostic information through different communication networks or through one identical communication network.

4. The multiple ECU diagnosing method of claim 3, wherein the MDIS of the diagnostic equipment recombines the diagnosis request information selected by the user and transmits the diagnosis request information to the gateway through the Ethernet communication network.

5. The multiple ECU diagnosing method of claim 3, wherein the MDP comprises types and number of ECUs to be diagnosed and the communication network type connected to the ECUs.

6. The multiple ECU diagnosing method of claim 3, wherein the different communication networks of different speeds include a CAN communication network, a FlexRay communication network, a LIN communication network, and a K-Line communication network, and wherein one identical communication network is selected from the CAN communication network, the FlexRay communication network, the LIN communication network, and the K-Line communication network.

* * * * *